US009445183B2

(12) United States Patent
Dahl

(10) Patent No.: US 9,445,183 B2
(45) Date of Patent: Sep. 13, 2016

(54) SOUND SYSTEM WITH EAR DEVICE WITH IMPROVED FIT AND SOUND

(71) Applicant: Linda D. Dahl, New York, NY (US)

(72) Inventor: Linda D. Dahl, New York, NY (US)

( * ) Notice: Subject to any disclaimer, the term of this patent is extended or adjusted under 35 U.S.C. 154(b) by 4 days.

(21) Appl. No.: 14/665,556

(22) Filed: Mar. 23, 2015

(65) Prior Publication Data

US 2015/0201269 A1 Jul. 16, 2015

Related U.S. Application Data

(63) Continuation-in-part of application No. 13/732,775, filed on Jan. 2, 2013, now Pat. No. 8,989,418, which is a continuation-in-part of application No. 12/038,434, filed on Feb. 27, 2008, now Pat. No. 8,391,526.

(51) Int. Cl.

| | |
|---|---|
| ***H04R 25/00*** | (2006.01) |
| ***H04R 1/10*** | (2006.01) |
| *H04R 3/00* | (2006.01) |

(52) U.S. Cl.

CPC ..... *H04R 1/1058* (2013.01); *H04R 25/656* (2013.01); *H04R 1/1016* (2013.01); *H04R 3/00* (2013.01); *H04R 25/658* (2013.01); *H04R 2201/107* (2013.01)

(58) Field of Classification Search

None

See application file for complete search history.

(56) References Cited

U.S. PATENT DOCUMENTS

| | | | | |
|---|---|---|---|---|
| 4,565,904 | A * | 1/1986 | Harada | H04R 25/652 381/322 |
| 5,659,156 | A | 8/1997 | Mauney et al. | |
| 7,856,111 | B2 | 12/2010 | Balke et al. | |
| 2004/0096077 | A1 | 5/2004 | Csensich et al. | |
| 2005/0111686 | A1 | 5/2005 | Bayer | |
| 2005/0169492 | A1 | 8/2005 | Topholm | |
| 2009/0097683 | A1* | 4/2009 | Burns | H04R 25/02 381/324 |
| 2009/0123010 | A1 | 5/2009 | Cano et al. | |
| 2011/0158440 | A1* | 6/2011 | Mei | H04R 1/1016 381/309 |
| 2012/0224734 | A1* | 9/2012 | Cohen | H04R 25/652 381/322 |
| 2015/0146909 | A1* | 5/2015 | Kirkpatrick | H04R 25/652 381/380 |
| 2016/0050479 | A1* | 2/2016 | Anderson | H04R 1/1025 381/74 |

* cited by examiner

*Primary Examiner* — Thang Tran

(74) *Attorney, Agent, or Firm* — Triangle Patents, PLLC

(57) ABSTRACT

A system for audio content delivery to an in-the-ear device from a local computing device. Also, a system for audio content delivery to an in-the-ear device from a content delivery network. The in-the-ear device is sized and shaped such that it universally and ergonomically fits into the human ear without slipping out and provides the user with a comfortable fit. The in-the-ear device is secured in the user's ear taking advantage of the natural curvature of the human to provide support and shift the center of gravity from outside the ear to further inside the pinna to prevent the device from slipping out while retaining a high level of comfort.

24 Claims, 9 Drawing Sheets

Right side
10
17
21
20
22
15
25
30

3/4
20
21
22
30
15
11
25

Top
20
21
17
30

Front
20
21
17
22
33
30

20
22
17
15
30
33
50
33

121

100
130

125
121

117
120

121

SOUND SYSTEM WITH EAR DEVICE WITH IMPROVED FIT AND SOUND

CROSS-REFERENCES TO RELATED APPLICATIONS

This application claims priority from, and is a continuation-in-part of application Ser. No. 13/732,775, filed Jan. 2, 2013, which is a continuation-in-part of application Ser. No. 12/038,434, filed Feb. 27, 2008, both of which are incorporated herein by reference in their entirety.

BACKGROUND OF THE INVENTION

1. Field of the Invention

The present invention relates generally to a device shaped to the outer ear for improving the sound quality and fit of various portable ear phones and sound producing equipment. Specifically, the invention is directed to anatomically fitted shells designed to fit securely inside the external ear and provide improved acoustics without the need to maximally increase audio settings while filtering background noise.

2. Description of the Related Art

Various types of ear buds and in-the-ear devices are manufactured in the prior art. Ear buds are used in various applications ranging from use in hearing aids, in high end systems typically used by professionals in the television, radio or music industry, and in commercially sold ear buds available for every use in conjunction with portable music players, telephones or other handheld devices.

Such existing universally adaptable ear buds typically fall out of the ear canal or cause discomfort. Improved versions rely on a deep and tight insertion into the ear canal to keep the device in the ear and prevent it from falling out. This type of deep and tight insertion technique tends to result in painful rubbing of the ear buds inside the ear canal and can also seal the ear canal. As a result, the user can experience irritation and discomfort, particularly after long uninterrupted use. Further, completely sealing the ear canal from the user's environment may have dangerous implications. It may affect a user's ability to hear ambient sound by reducing the intensity of the sound, and it may alter the user's ability to localize sound, particularly in the high frequencies where interaural sound pressure differences are the primary cue for localization. Also, even with the tight seal these devices continue to fall out of the ear canal due to their shape and the material from which they are made.

Many prior art devices are sold purely as ear bud adapters, without any internal electronics for the transmission of sound. Most commercially sold ear buds consist of an audio device implanted into a typically round plastic core with a rubberized shell. An example of a prior art ear bud adapter can be found in U.S. Pat. No. 5,659,156 issued to Mauney et al. ("Mauney"). Mauney discloses an ear bud adapter designed to minimize protrusion into the ear canal by providing a protrusion helix of the ear bud to fit under the crus of the ear's helix. This device is deficient however in that the balance of the device weight is outside the user's ear tending to cause the ear buds to slip out of the ear, particularly during physical activity such as running.

In addition, in-the-ear hearing aids used for people who have hearing loss are typically made in a skin tone color in order to blend into the wearer's ear. In reality, such devices stand out and can result in an awkward looking appearance. Such designs have in past resulted in a negative stigma being associated with hearing aid devices as they are not fashionable and tend to look like machinery. Such devices can negatively affect the self-esteem of hearing impaired people, and in particular children. Therefore placing a device in-the-ear canal that looks like a hearing aid also can have those associations.

Moreover, prior art universal ear buds, when used in conjunction with portable music devices, tend to require high decibel audio settings in order for music to be heard clearly. Such devices typically have poor acoustics and do not filter out interfering ambient noises thus requiring the need for ever louder audio settings. Of course such high level audio settings are proposed to be a leading cause of hearing loss in the general population.

Several high end ear buds have been developed for professionals requiring sound in their ears without bulky headsets. Television and music industry people routinely apply these solutions. Unfortunately the technology applied to these high technology solutions is costly and not a reasonable solution for a general public commercial release because they require custom made ear molds that fit only one individual.

In light of the above current prior art deficiencies a new and improved in-the-ear device shape is needed that provides the wearer with added fit and comfort without completely sealing off the wearer's ear from ambient noise. In addition there exists a need for new and improved in-the-ear device that remains situated in the wearer's ear especially during physical activity. Furthermore, there is a need for a new and improved in-the-ear device that removes the present negative stigma of hearing aid devices. Additionally there is a need for a more fashionable and fully functional in-the-ear device for use with universal audio devices that can help remove the stigma of in-the-ear hearing aids. Finally, a new and improved in-the-ear device is needed for universal fit so that production costs can be reduced such that sale to the general public can be accomplished at a reasonable per unit cost.

SUMMARY OF THE INVENTION

The present invention is directed to a system for audio content delivery, wherein the system includes an in-the-ear device sized and shaped such that it ergonomically and universally fits into the human ear without slipping out and providing the user with a comfortable fit.

It is an object of this invention to provide an audio content delivery system with an in-the-ear device which is secured in the user's ear by taking advantage of the elasticity and natural curvature of the human ear to provide support and shift the center of gravity of the device from outside the ear to further inside the auricle and ear canal. This will prevent the device from slipping out while retaining a high level of comfort.

It is a further object of this invention to provide an audio content delivery system with an in-the-ear device adaptable for various sound producing hardware devices while securing them in the user's ear.

It is also an object of the present invention to provide an audio content delivery system with an in-the-ear device which provides for improved acoustics by removing the need to increase the volume of any audio device adapted thereto, thereby possibly preventing hearing loss.

It is a further object of the present invention to provide an audio content delivery system with an in-the-ear device which isolates electrical components from the skin of the wearer.

The invented audio content delivery system with an in-the-ear device gains a stable mounting platform at the ear opening by using an extended helix of the in-the-ear device to allow it to fit under the crus of the helix of the ear and partially into the auditory canal. This configuration, combined with the placement of an adapted audio component further into the device, shifts its center of gravity more medially into the user's ear, taking further advantage of the natural shape of the ear to secure the in-the-ear device in a comfortable manner even during physical activity.

Another feature of the present invention is an improved in-the-ear device profile which follows the natural shape of the ear canal. By following the curvature of the ear canal, the wearer's comfort is greatly improved.

Additionally, the invented system includes an in-the-ear device made from a material that amplifies sound in such a way to clarify any audio device adapted thereto while retaining the ability of the wearer to hear ambient notices. Such a device allows a wearer retain the ability to localize sound.

In a first aspect, the present invention is directed to an audio content delivery device with a main in-the-ear body portion with a first side distal to a user, a second side medial to the user, a center of gravity, at least one speaker and a sound channel with a cavity; the speaker positioned within the cavity such that the center of gravity of the audio content delivery device is closer to the second side and more medial to the user. The device further includes a power supply and a wireless receiver with antenna, a processor, a memory for receiving digital audio content and controls and transmitting them to the at least one speaker.

The present invention is further directed to an audio content delivery system that includes at least one in-the-ear device and a local computing device in digital communication; the at least one in-the-ear device including a main body portion with a first side distal to a user, a second side medial to the user, a center of gravity, a speaker and a sound channel with a cavity; the speaker positioned within this cavity such that the center of gravity of the in-the-ear device closer to the second side and more medial to the user. The local computing device includes a processor and a memory; the local computing device streams audio content to the at least one in-the-ear device and controls the at least one in-the-ear device.

The present invention is still further directed to an audio content delivery system including at least one in-the-ear device, a local computing device and an audio content provider in digital communication through a network; wherein the at least one in-the-ear device includes a main body portion with a first side distal to a user, a second side medial to the user, a center of gravity, a speaker and a sound channel with a cavity. The speaker is positioned within the cavity such that the center of gravity of the in-the-ear device is closer to the second side and more medial to the user; and wherein the local computing device includes a processor and a memory; and wherein the audio content provider includes at least one computing device that includes at least one processor and a memory device. The audio content provider streams audio content to the local computing device and the local computing device streams the audio content to the in-the-ear device and controls the in-the-ear device.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE PREFERRED EMBODIMENTS

Figure 1:
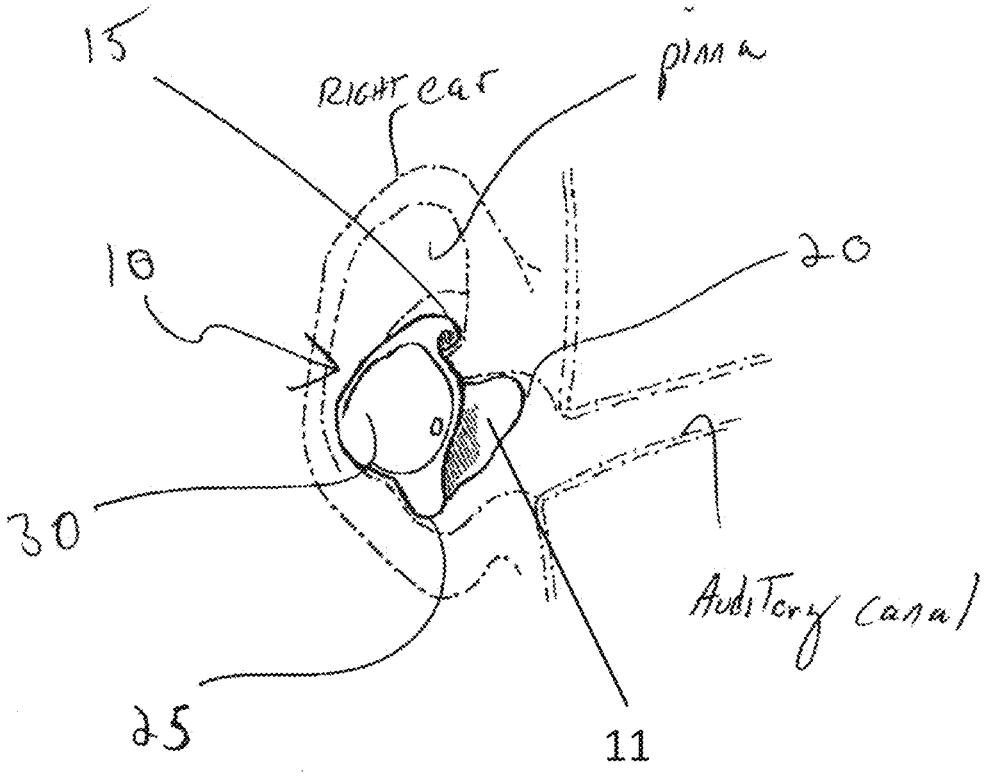
FIG. 1 shows a right ear view of the in-the-ear device inserted into a user's right ear.

The present disclosure will now be described more fully with reference to the Figures in which an embodiment of the present disclosure is shown. The subject matter of this disclosure may, however, be embodied in many different forms and should not be construed as being limited to the embodiments set forth herein. For example, the in-the-ear device can include hearing aids, including tinnitus devices; wireless audio devices, such as Bluetooth devices and surveillance listening devices; electronic fluency devices (stuttering devices); and combinations thereof.

The outer ear is the external portion of the ear, which consists of the pinna, concha, and auditory meatus and canal. It gathers sound energy and focuses it on the eardrum (tympanic membrane). One consequence of the configuration of the external ear is to selectively boost the sound pressure 30- to 100-fold for frequencies around 3000 Hz. This amplification makes humans most sensitive to frequencies in this range and also explains why they are particularly prone to acoustical injury and hearing loss near this frequency. Most human speech sounds are also distributed in the bandwidth around 3 kHz.

The pinna provides protection for the middle ear in order to prevent damage to the eardrum. The outer ear also channels sound waves which reach the middle ear through the ear canal to the eardrum. Because of the length of the ear canal, it is capable of amplifying sounds with frequencies of approximately 3000 Hz. As sound travels through the outer ear, the sound is still in the form of a pressure wave, with an alternating pattern of high and low pressure regions. It is not until the sound reaches the eardrum at the interface of the outer and the middle ear that the energy of the mechanical wave becomes converted into vibrations of the bones of the middle ear.

The middle ear is medial to the pinna. It is an air-filled cavity which consists of an eardrum and three tiny, interconnected bones—the malleus, incus, and stapes. The eardrum is a very durable and tightly stretched membrane which vibrates as the incoming pressure waves reach it. As shown below, a compression forces the eardrum inward and a rarefaction forces the eardrum outward, thus vibrating the eardrum at the same frequency as the sound wave.

Overall, the present invention provides an in-the-ear device, suitable for wearing in a user's outer ear, the in-the-ear device including: a main body portion or housing with a first side distal to the user, a second side medial to the user, a center of gravity, and a sound channel acoustically directed into the user's auditory canal; the sound channel having a cavity to receive a sound producing device; and the cavity having a depth of about 0.10 inches, thus positioning the center of gravity of the ear device closer to the second side and more medial to the user, thereby providing an in-the-ear device that remains situated in the user's ear during physical activity. The depth of the cavity of the present invention is a functional means to shift the center of gravity inward. The device would not have the same ability to stay in the ear if the cavity were much deeper. The reduction in size of the cavity is not to provide less weight and therefore increased comfort, but rather to shift the center of gravity.

In preferred embodiments, the device further includes a first protuberance that fits under the crus of the helix of the user's ear, and a second protuberance that extends into the user's ear canal but does not sealingly engage the ear canal. Also, preferably, the device further includes at least one alignment mark placed on the first side and below the first protuberance, for positioning of the sound producing device within the cavity. Additionally, the device includes a notch that provides contact relief to the user's antitragus. Advantageously, the center of gravity location, combined with the size and shape of the device, cavity and protuberance(s), securely retain the placement in the user's ear until intentional extraction or removal by the user. Thus, the present invention provides a non-custom, in-the-ear device for improving hearing, wherein the device is removably insertable into the user's ear such that the device remains in place after insertion, even during physical activities, and is removable by the user as desired.

The present invention thus includes a hearing enhancement device including: a body housing constructed and configured for insertion into a human ear of a user, the body housing having a first side distal to the user, a second side medial to the user, a center of gravity of the device, and a sound channel acoustically directed into the user's auditory canal; the sound channel having a cavity to receive a sound producing device, wherein when the body housing is removably inserted into the human ear, the center of gravity of the device is positioned closer to the second side, thereby providing an in-the-ear device that remains situated in the user's ear during physical activity. The device further includes a first protuberance that fits under the crus of the helix of the user's ear; at least one alignment mark placed on the first side and below the first protuberance, for positioning of the sound producing device within the cavity; a notch that provides contact relief to the user's antitragus; a second protuberance that extends into the user's ear canal but does not sealingly engage the ear canal; and wherein the cavity has a depth of about 0.10 inches. The device is preferably made from an electrical insulating material and may also be made from a rigid material. The cavity and the sound bore are constructed and configured to amplify sound from a sound producing device located within the cavity without causing damage to the user's ear drum. The device is selected from the group consisting of hearing aids, tinnitus devices, wireless audio devices, electronic fluency devices, and combinations thereof.

Thus, the present invention teaches a gravity-based approach to holding the device in the ear. This differs from the prior art, which does not describe the use of gravity or adjustment of the center of gravity of the device to hold the device in the ear. Rather, the prior art relies on friction and/or the crux of the helix to hold the device in place. For example, the prior art teaches twisting the device to engage the helix of the device with the helix of the ear and/or inserting the device snugly enough that the contact friction between the device and the ear canal prevents the device from falling out.

Thus, the present invention provides an in-the-ear device that does not fall out of the ear canal and does not cause discomfort. It does not require deep and tight insertion to keep the device in the ear and thus does not seal the ear and eliminates painful rubbing, thus reducing irritation and discomfort. The present invention does not seal the ear, thereby not eliminating the user's ability to hear ambient sound or the ability to localize sound. Because the device is less conspicuous than prior art devices, it is less likely to negatively affect the self-esteem of the user. The present invention does not require high decibel audio setting in order to function properly. The present invention is thus a less costly solution for general public commercial use because it provides the necessary performance without requiring customization.

Figure 2:
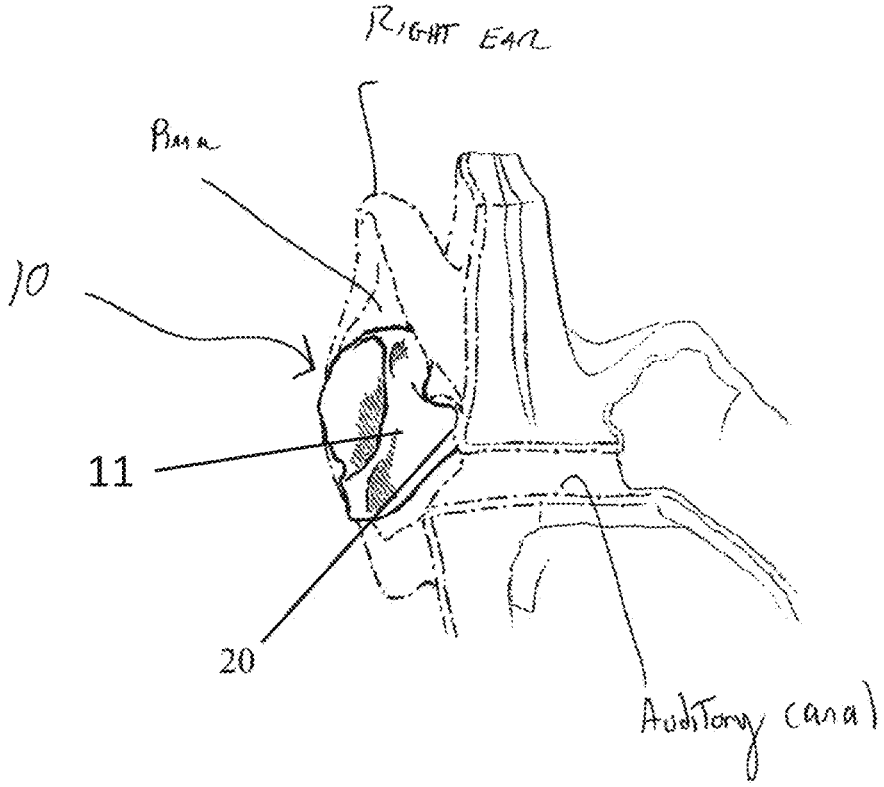
FIG. 2 shows the in-the-ear device of FIG. 1 ear from a partial front side view.

Referring now to FIG. 1 there is shown a side view of a wearer's ear with the in-the-ear device 10 in place. Auditory canal portion 20 is preferably placed slightly into the auditory canal while protuberance 15 is positioned in the conchal bowl and protuberance 25 is positioned under the crus in the helix. Cavity 30 is shown without a sound producing device inserted therein, however the combination of the cavity 30 in the main body portion 11 along with an inserted audio device provides for the center gravity of the device further into the wearer's ear. Hence the device is secured better in the wearer's ear. Referring now FIG. 2 there is shown the in-the-ear device of FIG. 1 from a cut away aside view. As can be seen auditory canal portion 20 is slightly elongated medially such that it inserts into the auditory canal, thus shifting the center of gravity of the in-the-ear device medially to maintain the device in the wearer's ear. It has been found that this configuration provides support for the device even during physical activity, such as running, while maintaining a high level of comfort.

Referring now to FIGS. 3A-3E the in-the-ear device is shown from various views. Cavity 30 is in gas communication with orifice 21 via bore 22, such that sound from and inserted audio device may exit orifice 21 and enter into the wearer's auditory canal. The anatomical shape of various portions of device 10, including protuberance 25 and protuberance 15, ensures that device 10 fits the ears of a great majority of the entire adult human population. Notch 17, located between protuberances 15 and 20, is shaped to engage just under the helix of the outer ear.

It has been found that the human outer ear is as unique as a finger print but the auricle is elastic. Taking advantage of this elasticity, the present invention advantageously fits most of the population without requiring customization of the outer part of the housing. So the device of the present invention provides a general or generic outer shape and size that fits most adult human ears for insertion therein, and so the device maybe mass produced to reduce the per-unit cost making the device, thus improving affordability and efficiency of time and cost by not requiring customization, while providing a consistent fit and feel. Preferably, the device is made from a solid material that is electrically insulated. Such materials may include porcelain, plastic, vulcanized rubber or other similar material. A solid device is suitable because the outer ear is made from flexible human tissue (cartilage). Such flexibility allows for a solid, naturally shaped device to fit comfortably while providing clear audio. Also, preferably, the device housing is made from a rigid material.

Figures 3A, 3B, 3C, 3D, 3E:
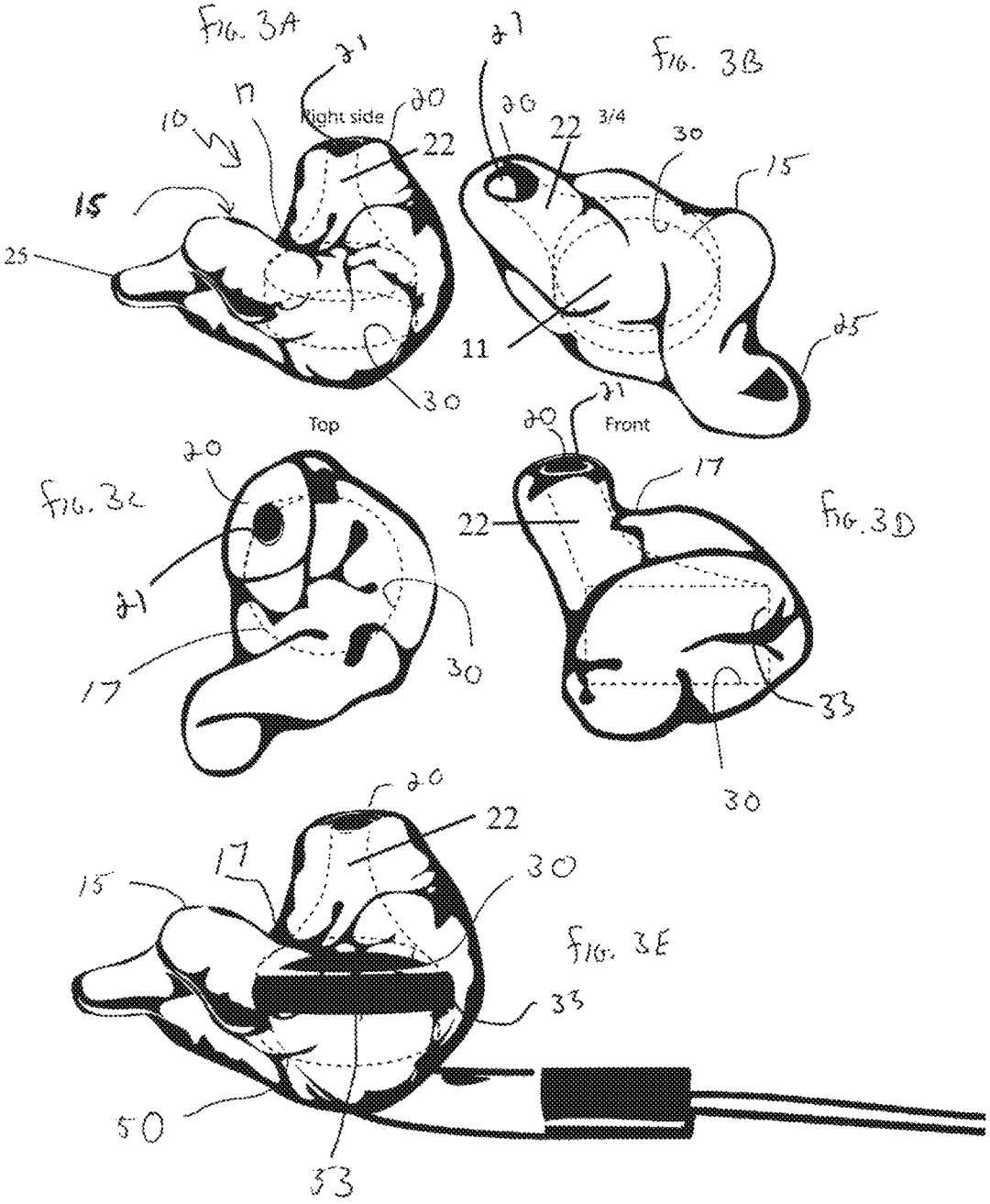
FIGS. 3A-3E show the in-the-ear device from various views according one embodiment of the present invention.

FIG. 3E shows an example of the in-the-ear device with a consumer portable speaker plug 50 inserted into cavity 30. Cavity 30 preferably includes sides 33 having a rough surface such that when engaged with ear phone outer surface 53 there is a friction fit. In some embodiments surface 33 includes locking ridges to permanently engage and secure an audio device. In still other devices surface 33 includes threads or snap fit type junction to releasably engage an audio device. In addition, an audio device may be encased in the in-the-ear device so that it is manufactured as one piece.

Cavity 30 is shown with a round cross sectional shape having a diameter of about 0.25 inches. The depth of cavity 33 preferably is about 0.10 inches. However it is understood that cavity 30 may have other shapes and sizes to adapt to the market.

Figures 4A, 4B:
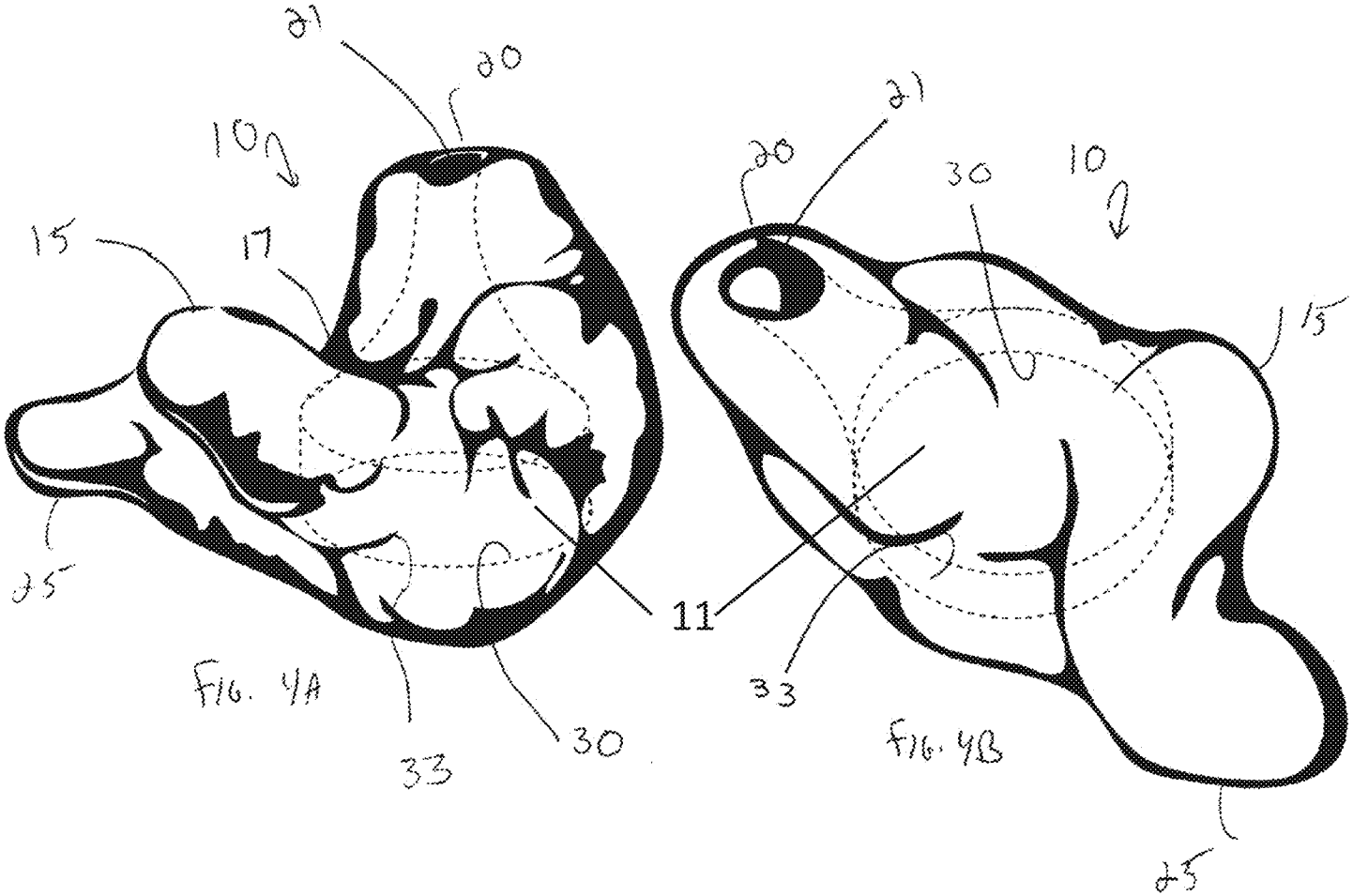
FIGS. 4A-4B show an enlarge view of the in-the-ear device shown in FIGS. 3A and 3B according to one embodiment of the present invention.
Figures 5A, 5B, 5C, 5D, 5E, 5F:
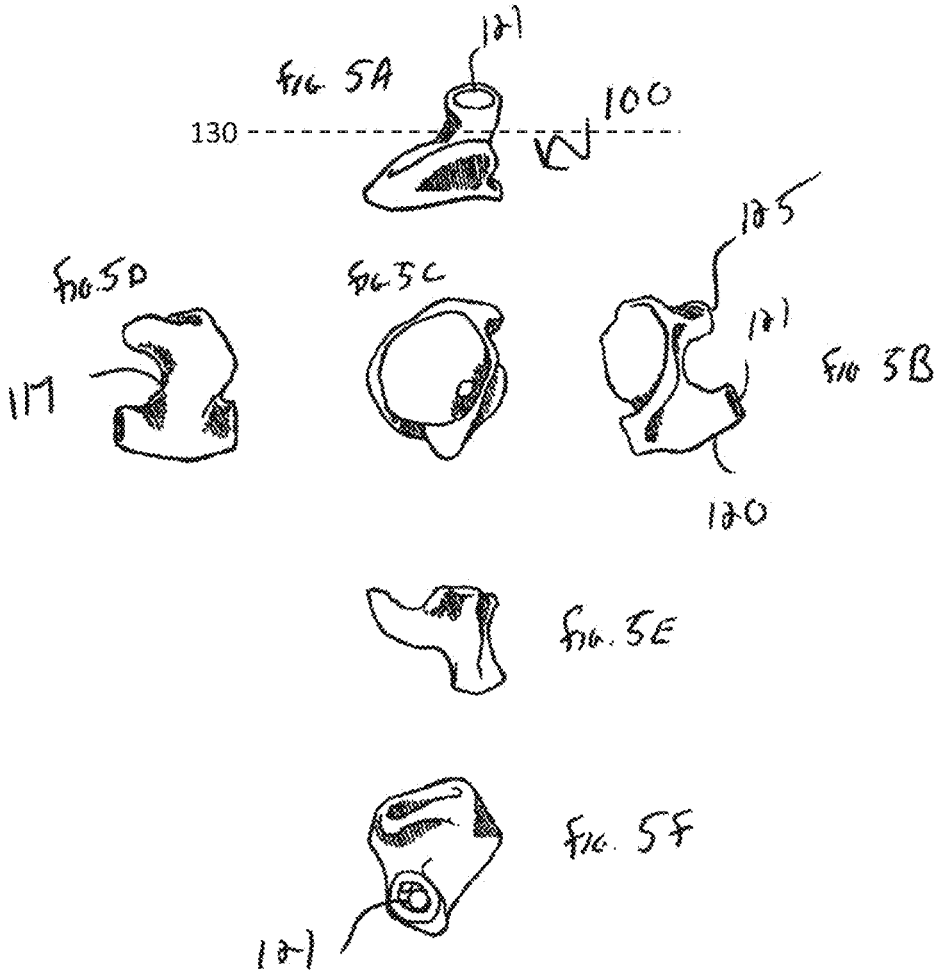
FIGS. 5A-5F show the in-the-ear device from various views according another embodiment of the invention.

FIGS. 4A and 4B show enlarged views of the in-the-ear device as shown in FIGS. 3A and 3B.

FIGS. 5A-5F show an alternative design for the in-the-ear device 100 in views from all sides of the device. Device 100 similarly includes an auditory canal portion 120 with notch 117 and upper protuberance 125. The auditory canal portion 120 includes an orifice 121. When placed in a wearer's ear the auditory canal portion 120 is inserted into the auditory canal such that the sound traveling out of orifice 121 is unobstructed while background noise is not entirely filtered. In this connection, the wearer will be able to hear clear sound without requiring a loud sound level from an inserted audio device and without being sealed from outside sound.

In another embodiment, the device is designed and constructed so that the center of gravity of the device is located in the auditory canal portion 20, thus positioning the center of gravity within the auditory canal of the user when the device is in use. Positioning the center of gravity inside the auditory canal helps secure the device in the ear because the device will tend to tilt medially, into the user's ear, rather than away from the ear. The center of gravity 130 is shown thus positioned in FIG. 5*a*.

Figure 6:
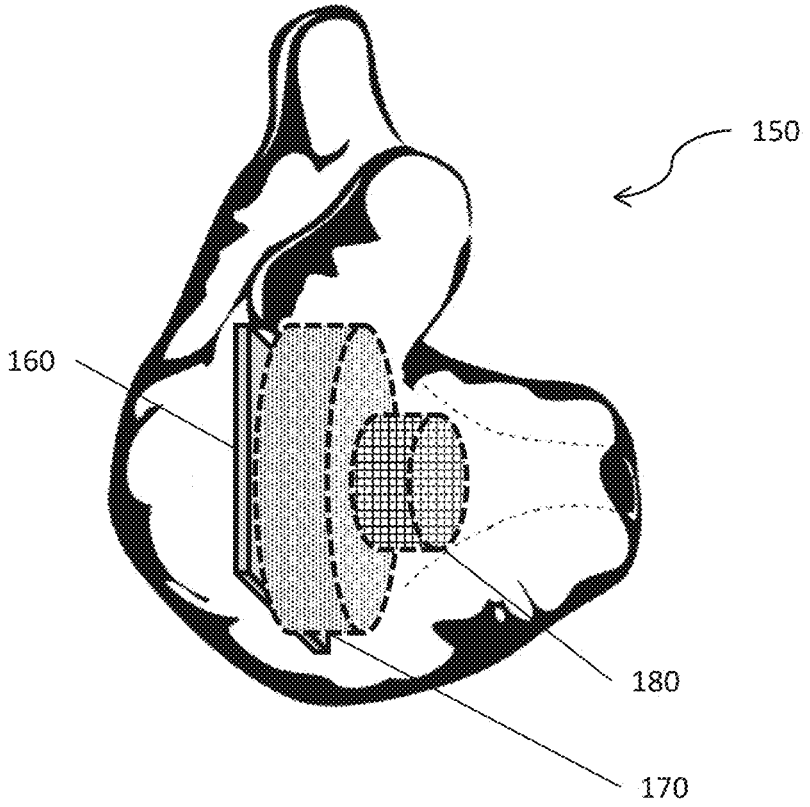
FIG. 6 shows a cut-away view of another device embodiment according to the present invention.

The present invention further provides for a device and systems for digital content delivery. Generally shown as 150 in FIG. 6, the audio content delivery device includes an in-the-ear device as previously described, and further including a circuit board 160 with an input receiver, a processor and a memory; a power supply 170; and at least one speaker 180. The input receiver can be wired or wireless. In the case of a wireless receiver, the circuit board includes an antenna, preferably embedded in the circuit board. The circuit board, power supply and speaker are positioned within the previously described cavity, thus positioning the center of gravity of the audio content delivery device closer to the second side and more medial to the user. The device thereby provides audio content delivery and remains situated in the user's ear during activity.

Figure 7:
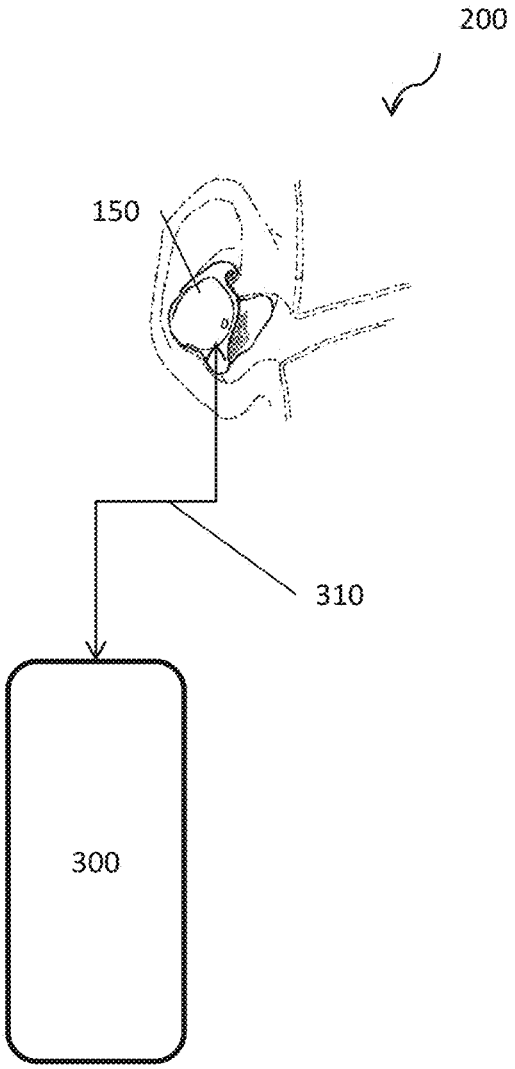
FIG. 7 shows a schematic view of a system according to the present invention.

The present invention further provides a system for transmitting digital audio content. FIG. 7 shows an example system embodiment, generally described as 200, which includes at least one in-the-ear-device 150, preferably two devices, in digital communication with a local computing device 300. The local computing device can include such devices as mobile telephones, personal computers, tablets and personal digital assistants; and digital appliances such as music systems, home security systems, environmental control systems and the like. The local computing device includes a processor, a memory and controls. The local computing device streams audio content to the in-the-ear device and controls the in-the-ear device.

The in-the-ear device and the local computing device operate in one-way or two-way communication 310. In one-way communication, the local computing device transmits commands and content to the in-the-ear device. In a preferred embodiment, wireless communication is provided. In an alternative embodiment, the communication is provided by wired transmission. Commands include, by way of example and not limitation, commands for controlling audio devices such as on/off, mute, balance (when multiple devices or multiple speakers are used), frequency-specific volumes, pitch, and combinations thereof. In two-way communication, the in-the-ear device additionally transmits status information back to the local computing device. Such information includes, but is not limited to volume, circuit temperature, device component damage, and combinations thereof.

The in-the-ear device also preferably includes buffer memory for buffering streaming audio content.

The data transmission 310 is through a wire or, preferably, through wireless communication by antennae of the in-the-ear device and the local computing device. The transceiver antenna in the in-the-ear device is preferably incorporated into the circuit board.

The wireless transmission is provided by any suitable wireless communication, wireless network communication, standards-based or non-standards-based, by way of example and not limitation, radiofrequency, Bluetooth, zigbee, wi-fi, near field communication and the like. At the local computing device, the output data can be viewed and assessed by the one or multiple users.

Figure 8:
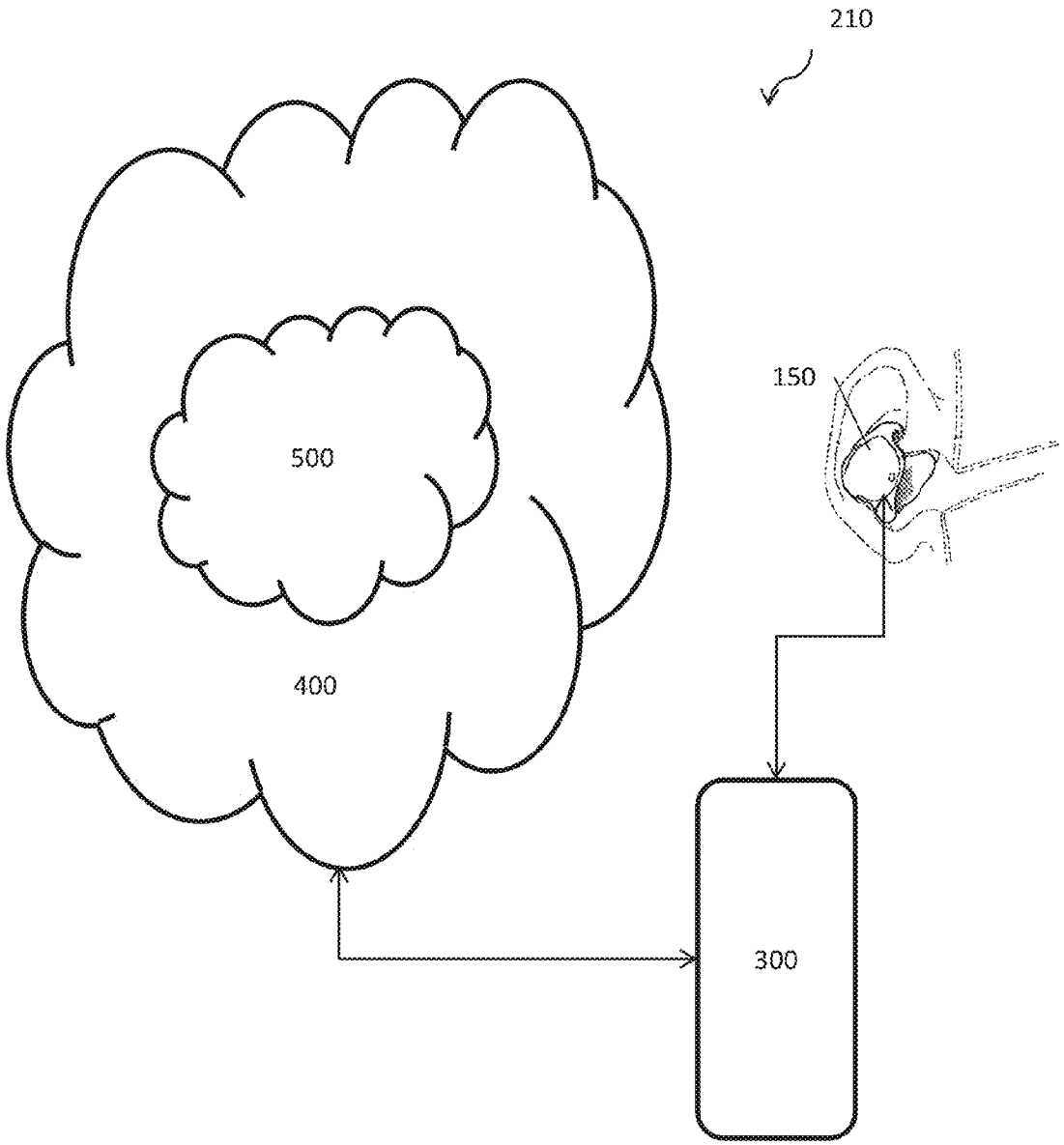
FIG. 8 shows another schematic view of a system embodiment of the present invention.

The present invention further includes a system for transmitting digital audio content from storage devices through a network to the local computing device. FIG. 8 shows an example embodiment, generally described as 210, wherein the local computing device 300 is in communication through a network 400 with other audio content providers 500, shown here as a cloud computing system. Preferably, the content is delivered by a content delivery network (CDN).

Figure 9:
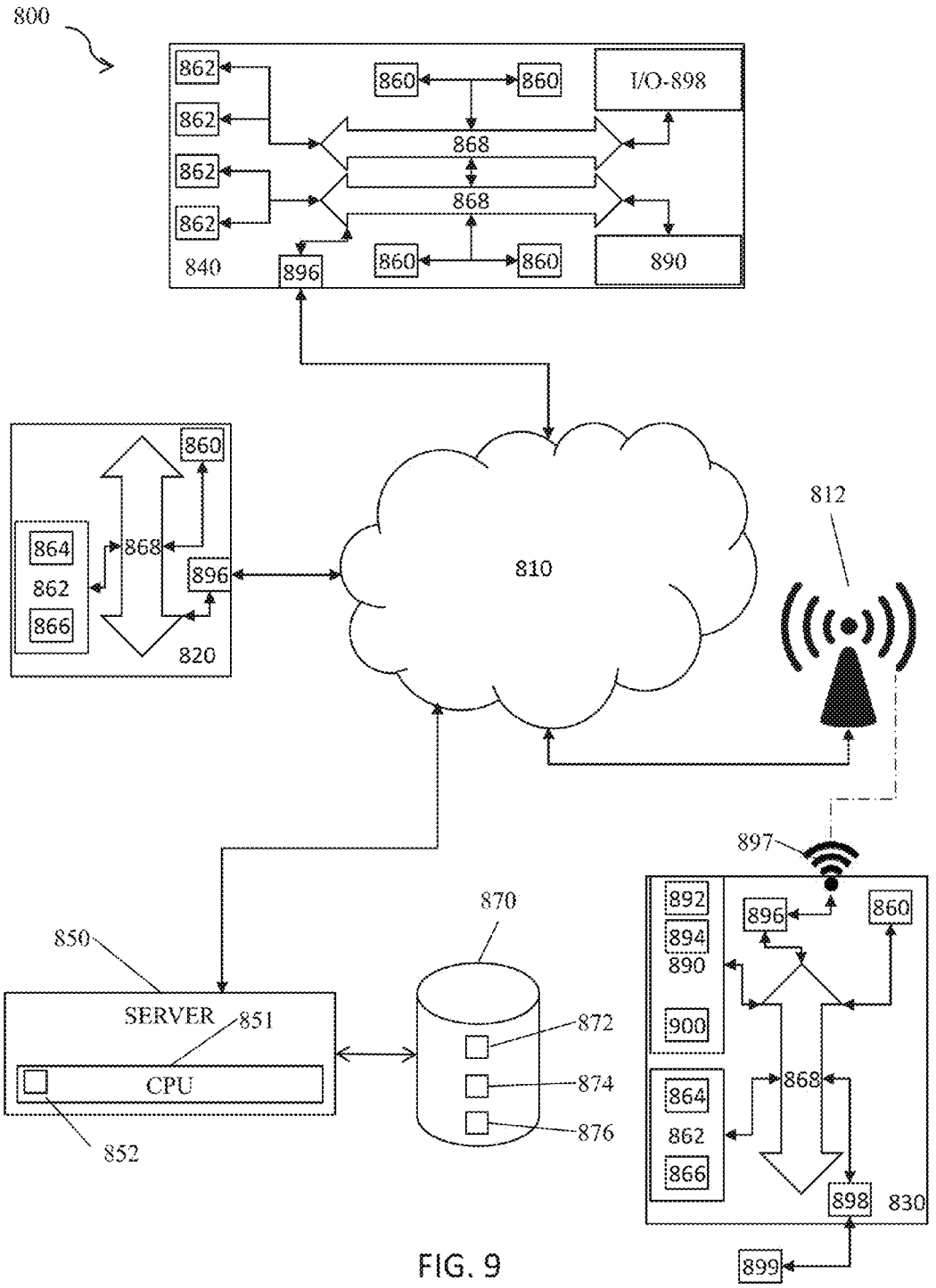
FIG. 9 shows a schematic diagram illustrating general components another system of the present invention including a cloud-based computing system.

FIG. 9 is a schematic diagram of an embodiment of the invention illustrating a cloud-based computer system, generally described as 800, having a network 810, a plurality of computing devices 820, 830, 840, a server 850 and a database 870. The server 850 is constructed, configured and coupled to enable communication over a network 810 with a computing devices 820, 830, 840. The server 850 includes a processing unit 851 with an operating system 852. The operating system 852 enables the server 850 to communicate through network 810 with the remote, distributed user devices. Database 870 may house an operating system 872, memory 874, and programs 876.

In one embodiment of the invention, the system 800 includes a cloud-based network 810 for distributed communication via a wireless communication antenna 812 and processing by a plurality of mobile communication computing devices 830. In another embodiment of the invention, the system 800 is a virtualized computing system capable of executing any or all aspects of software and/or application components presented herein on the computing devices 820, 830, 840. In certain aspects, the computer system 800 may be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of digital computers 820, 840, 850 and mobile devices 830, such as a server, blade server, mainframe, mobile phone, a personal digital assistant (PDA), a smart phone, a desktop computer, a netbook computer, a tablet computer, a workstation, a laptop, and other similar computing devices. The components shown here, their connections and relationships, and their functions, are meant to be exemplary only, and are not meant to limit implementations of the invention described and/or claimed in this document In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 may additionally include components such as a storage device 890 for storing the operating system 892 and one or more application programs 894, a network interface unit 896, and/or an input/output controller 898. Each of the components may be coupled to each other through at least one bus 868. The input/output controller 898 may receive and process input from, or provide output to, a number of other devices 899, including, but not limited to, alphanumeric input devices, mice, electronic styluses, display units, touch screens, signal generation devices (e.g., speakers) or printers.

By way of example, and not limitation, the processor 860 may be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 9, multiple processors 860 and/or multiple buses 868 may be used, as appropriate, along with multiple memories 862 of multiple types (e.g., a combination of a DSP and a microprocessor, a plurality of microprocessors, one or more microprocessors in conjunction with a DSP core).

Also, multiple computing devices may be connected, with each device providing portions of the necessary operations (e.g., a server bank, a group of blade servers, or a multiprocessor system). Alternatively, some steps or methods may be performed by circuitry that is specific to a given function.

According to various embodiments, the computer system 800 may operate in a networked environment using logical connections to local and/or remote computing devices 820, 830, 840, 850 through a network 810. A computing device 830 may connect to a network 810 through a network interface unit 896 connected to the bus 868. Computing devices may communicate communication media through wired networks, direct-wired connections or wirelessly such as acoustic, RF or infrared through an antenna 897 in communication with the network antenna 812 and the network interface unit 896, which may include digital signal processing circuitry when necessary. The network interface unit 896 may provide for communications under various modes or protocols.

In one or more exemplary aspects, the instructions may be implemented in hardware, software, firmware, or any combinations thereof. A computer readable medium may provide volatile or non-volatile storage for one or more sets of instructions, such as operating systems, data structures, program modules, applications or other data embodying any one or more of the methodologies or functions described herein. The computer readable medium may include the memory 862, the processor 860, and/or the storage media 890 and may be a single medium or multiple media (e.g., a centralized or distributed computer system) that store the one or more sets of instructions 900. Non-transitory computer readable media includes all computer readable media, with the sole exception being a transitory, propagating signal per se. The instructions 900 may further be transmitted or received over the network 810 via the network interface unit 896 as communication media, which may include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory or other solid state memory technology, disks or discs (e.g., digital versatile disks (DVD), HD-DVD, BLU-RAY, compact disc (CD), CD-ROM, floppy disc) or other optical storage, magnetic cassettes, magnetic tape, magnetic disk storage or other magnetic storage devices, or any other medium that can be used to store the computer readable instructions and which can be accessed by the computer system 800.

It is also contemplated that the computer system 800 may not include all of the components shown in FIG. 9, may include other components that are not explicitly shown in FIG. 9, or may utilize an architecture completely different than that shown in FIG. 9. The various illustrative logical blocks, modules, elements, circuits, and algorithms described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

By way of definition and description supporting the claimed subject matter, preferably, the present invention includes communication methodologies for transmitting data, data packets, messages or messaging via a communication layer. Wireless communications over a network are preferred. Correspondingly, and consistent with the communication methodologies for transmitting data or messaging according to the present invention, as used throughout this specification, figures and claims, wireless communication is provided by any reasonable protocol or approach, by way of example and not limitation, Bluetooth, Wi-Fi, cellular, zigbee, near field communication, and the like; the term "ZigBee" refers to any wireless communication protocol adopted by the Institute of Electronics & Electrical Engineers (IEEE)

according to standard 802.15.4 or any successor standard(s), the term "Wi-Fi" refers to any communication protocol adopted by the IEEE under standard 802.11 or any successor standard(s), the term "WiMax" refers to any communication protocol adopted by the IEEE under standard 802.16 or any successor standard(s), and the term "Bluetooth" refers to any short-range communication protocol implementing IEEE standard 802.15.1 or any successor standard(s). Additionally or alternatively to WiMax, other communications protocols may be used, including but not limited to a "1G" wireless protocol such as analog wireless transmission, first generation standards based (IEEE, ITU or other recognized world communications standard), a "2G" standards based protocol such as "EDGE or CDMA 2000 also known as 1×RTT", a 3G based standard such as "High Speed Packet Access (HSPA) or Evolution for Data Only (EVDO), any accepted 4G standard such as "IEEE, ITU standards that include WiMax, Long Term Evolution "LTE" and its derivative standards, any Ethernet solution wireless or wired, or any proprietary wireless or power line carrier standards that communicate to a client device or any controllable device that sends and receives an IP based message. The term "High Speed Packet Data Access (HSPA)" refers to any communication protocol adopted by the International Telecommunication Union (ITU) or another mobile telecommunications standards body referring to the evolution of the Global System for Mobile Communications (GSM) standard beyond its third generation Universal Mobile Telecommunications System (UMTS) protocols. The term "Long Term Evolution (LTE)" refers to any communication protocol adopted by the ITU or another mobile telecommunications standards body referring to the evolution of GSM-based networks to voice, video and data standards anticipated to be replacement protocols for HSPA. The term "Code Division Multiple Access (CDMA) Evolution Date-Optimized (EVDO) Revision A (CDMA EVDO Rev. A)" refers to the communication protocol adopted by the ITU under standard number TIA-856 Rev. A.

It will be appreciated that embodiments of the invention described herein may be comprised of one or more conventional processors and unique stored program instructions that control the one or more processors to implement, in conjunction with certain non-processor circuits, some, most, or all of the functions for the systems and methods as described herein. The non-processor circuits may include, but are not limited to, radio receivers, radio transmitters, antennas, modems, signal drivers, clock circuits, power source circuits, relays, current sensors, and user input devices. As such, these functions may be interpreted as steps of a method to distribute information and control signals between devices. Alternatively, some or all functions could be implemented by a state machine that has no stored program instructions, or in one or more application specific integrated circuits (ASICs), in which each function or some combinations of functions are implemented as custom logic. Of course, a combination of the two approaches could be used. Thus, methods and means for these functions have been described herein. Further, it is expected that one of ordinary skill in the art, notwithstanding possibly significant effort and many design choices motivated by, for example, available time, current technology, and economic considerations, when guided by the concepts and principles disclosed herein, will be readily capable of generating such software instructions, programs and integrated circuits (ICs), and appropriately arranging and functionally integrating such non-processor circuits, without undue experimentation.

It will be apparent to one of skill in the art that described herein is a novel system and method for providing audio content. While the invention has been described with reference to specific preferred embodiments, it is not limited to these embodiments. Certain modifications and improvements will occur to those skilled in the art upon a reading of the foregoing description, by way of example, improvements in microelectronic digital audio technology can be incorporated into the present invention without departing from the scope. The invention may be modified or varied in many ways and such modifications and variations as would be obvious to one of skill in the art are within the scope and spirit of the invention and are included within the scope of the following claims.

The invention claimed is:

1. An audio content delivery device comprising:

a main in-the-ear body portion with a first side distal to a user, a second side medial to the user, a center of gravity, at least one speaker and a sound channel with a cavity; the speaker positioned within the cavity such that the center of gravity of the audio content delivery device is closer to the second side and more medial to the user for ensuring that the audio content delivery device remains situated in the user's ear during physical activity;

the audio content delivery device further comprising in the cavity a wireless receiver with antenna, a processor, a memory, and a power supply for receiving digital audio content and transmitting the digital audio content to the at least one speaker.

2. The device of claim 1, further comprising a first protuberance that fits under the crus of the helix of the user's ear.

3. The device of claim 1, further comprising a notch that provides contact relief to the user's antitragus.

4. The device of claim 2, further comprising a second protuberance that extends into the user's ear canal but does not sealingly engage the ear canal.

5. The device of claim 1, wherein wireless receiver is a 2-way transceiver.

6. The device of claim 1, wherein the main body portion is not flexible.

7. An audio content delivery system comprising:

at least one in-the-ear device and a local computing device in digital communication;

the at least one in-the-ear device comprising a main body portion with a first side distal to a user, a second side medial to the user, a center of gravity, a speaker and a sound channel with a cavity; the speaker positioned within the cavity such that the center of gravity of the in-the-ear device closer to the second side and more medial to the user for ensuring that the in-the-ear device remains situated in the user's ear;

the local computing device comprising at least one processor and at least one memory, the local computing device streaming audio content to the at least one in-the-ear device and controlling the at least one in-the-ear device.

8. The system of claim 7, wherein the digital communication is wireless and the at least one in-the-ear device further comprises a wireless receiver with antenna, a processor, a memory, and a power supply; and the local computing device further comprises a wireless transmitter.

9. The system of claim 8, wherein the digital communication is 2-way, the at least one in-the-ear device and local computing device each further comprise a wireless transceiver.

10. The device of claim 7, further comprising a first protuberance that fits under the crus of the helix of the user's ear.

11. The device of claim 7, further comprising a notch that provides contact relief to the user's antitragus.

12. The device of claim 10, further comprising a second protuberance that extends into the user's ear canal but does not sealingly engage the ear canal.

13. The device of claim 7, wherein wireless receiver is a 2-way transceiver.

14. The device of claim 7, wherein the main body portion is not flexible.

15. An audio content delivery system comprising:

at least one in-the-ear device, a local computing device and an audio content provider in digital communication through a network;

the at least one in-the-ear device comprising a main body portion with a first side distal to a user, a second side medial to the user, a center of gravity, a speaker and a sound channel with a cavity; the speaker positioned within the cavity such that the center of gravity of the in-the-ear device is closer to the second side and more medial to the user for ensuring that the in-the-ear device remains situated in the user's ear;

the local computing device comprising at least one processor and at least one memory, the audio content provider comprising at least one computing device comprising at least one processor and at least one memory;

the audio content provider streaming audio content to the local computing device and the local computing device streaming audio content to the in-the-ear device and controlling the in-the-ear device.

16. The system of claim 15, wherein the digital communication is wireless and the in-the-ear device further comprises a wireless receiver with antenna, a processor, a memory, and a power supply; and the local computing device further comprises a wireless transmitter.

17. The system of claim 16, wherein the digital communication is 2-way, the in-the-ear device and local computing device further comprise a wireless transceiver.

18. The system of claim 15, wherein the audio content provider is a content delivery network.

19. The system of claim 15, wherein the audio content provider is a cloud computing network.

20. The device of claim 15, further comprising a first protuberance that fits under the crus of the helix of the user's ear.

21. The device of claim 15, further comprising a notch that provides contact relief to the user's antitragus.

22. The device of claim 20, further comprising a second protuberance that extends into the user's ear canal but does not sealingly engage the ear canal.

23. The device of claim 15, wherein wireless receiver is a 2-way transceiver.

24. The device of claim 15, wherein the main body portion is not flexible.

* * * * *